US011519647B2

(12) United States Patent
Wasily et al.

(10) Patent No.: US 11,519,647 B2
(45) Date of Patent: Dec. 6, 2022

(54) COOLING SYSTEM USING VACUUM COOLING

(71) Applicant: V-CHILLER KFT., Budapest (HU)

(72) Inventors: Amir Wasily, Budapest (HU); Peter Wasily, Budapest (HU)

(73) Assignee: V-CHILLER KFT., Budapest (HU)

( * ) Notice: Subject to any disclaimer, the term of this patent is extended or adjusted under 35 U.S.C. 154(b) by 0 days.

(21) Appl. No.: 17/276,803

(22) PCT Filed: Sep. 27, 2019

(86) PCT No.: PCT/EP2019/076188

§ 371 (c)(1),
(2) Date: Mar. 16, 2021

(87) PCT Pub. No.: WO2020/065011

PCT Pub. Date: Apr. 2, 2020

(65) Prior Publication Data

US 2021/0285706 A1 Sep. 16, 2021

(30) Foreign Application Priority Data

Sep. 28, 2018 (EP) ..... 18197702

(51) Int. Cl.
*F25B 43/04* (2006.01)

(52) U.S. Cl.
CPC ..... *F25B 43/04* (2013.01)

(58) Field of Classification Search
CPC ..... F25B 43/04; F17C 2227/045; F25D 2317/043; F25D 31/00
(Continued)

(56) References Cited

U.S. PATENT DOCUMENTS 3,146,602 A 9/1964 Swearingen
4,398,399 A 8/1983 Itoh et al.
(Continued)

FOREIGN PATENT DOCUMENTS

EP 0577869 A1 1/1994
EP 2226601 A1 9/2010
(Continued)

OTHER PUBLICATIONS

European Patent Office, Extended European Search Repod Issued in Application No. 18197702.6, dated May 13, 2019, Germany, 8 pages.

(Continued)

*Primary Examiner* — Steve S Tanenbaum
(74) *Attorney, Agent, or Firm* — McCoy Russell LLP

(57) ABSTRACT

Cooling system using vacuum cooling and method for operating the same, said system having a refrigerant circulation, the refrigerant circulation comprising:

a vacuum chamber,
a vacuum pump,
a first flow of a heat exchanger of the cooling system having at least two flows, and
a condensate reservoir,
wherein the vacuum chamber, the vacuum pump, the first flow and the condensate reservoir are connected,
wherein a refrigerant contained within the refrigerant circulation is liquid at 20 C and 101325 Pa,
wherein the system further comprises a separator having an inlet connected to the condensate reservoir for receiving a gaseous phase from the condensate reservoir, an outlet connected to an inlet of the vacuum pump and an exhaust for leakage air.

13 Claims, 2 Drawing Sheets

(58) Field of Classification Search
USPC ..... 62/475
See application file for complete search history.

(56) References Cited

U.S. PATENT DOCUMENTS

| | | | | |
|---|---|---|---|---|
| 5,806,322 | A | 9/1998 | Cakmakci et al. | |
| 9,897,364 | B2 | 2/2018 | Kuehl et al. | |
| 2012/0312379 | A1 * | 12/2012 | Gielda ..... | F25B 41/00<br>137/334 |

FOREIGN PATENT DOCUMENTS

| | | | |
|---|---|---|---|
| JP | H06129736 | * | 5/1994 |
| JP | H06129736 | A | 5/1994 |
| WO | 2015116903 | A1 | 8/2015 |

OTHER PUBLICATIONS

ISA European Patent Office, International Search Repod Issued in Application No. PCT/EP2019/076188, dated Dec. 6, 2019, WIPO, 4 pages.
ISA European Patent Office, Written Opinion of the International Searching Authority Issued in Application No. PCT/EP2019/076188, dated Dec. 6, 2019, WIPO, 5 pages.

* cited by examiner

COOLING SYSTEM USING VACUUM COOLING

CROSS REFERENCE TO RELATED APPLICATIONS

The present application is a U.S. National Phase of International Application No. PCT/EP2019/076188 entitled "COOLING SYSTEM USING VACUUM COOLING," and filed on Sep. 27, 2019. International Application No. PCT/EP2019/076188 claims priority to European Patent Application No. 18197702.6 filed on Sep. 28, 2018. The entire contents of each of the above-listed applications are hereby incorporated by reference for all purposes.

TECHNICAL FIELD

Rapid cooling is highly needed in today's world, especially in the food and beverage markets where blast freezers rapidly freeze food products, can preserve food quality, prohibit bacterial growth and extend shelf life. The current and most common way of cooling nowadays is vapour-compression refrigeration cycle (VCRS) in which to achieve rapid cooling with VCRS a lot of energy is required and the equipment is very large and expensive.

BACKGROUND AND SUMMARY

The most efficient and economical way to achieve rapid cooling is by using vacuum cooling, in which by putting a liquid (e.g. water) in an airtight chamber (vacuum chamber) and lowering down the pressure below the vapour pressure of the liquid, the liquid starts boiling to reach equilibrium with the new pressure temperature state, while the liquid requires energy in the form of heat to induce boiling and change phase from liquid to gas, since the boiling is induced by reduced pressure not by adding heat and since there is no source of heat added to the body of liquid, the heat required for phase change is absorbed from the liquid itself, which results in the cooling effect.

The cooling effect is directly proportional to the amount of liquid evaporating. To increase the boiling rate, the vacuum pump has to have a very high sucking flow so that it will move out a lot of evaporated gases out of the chamber in which the more the vacuum pump pull out of the vacuum chamber the more the liquid has to boil to reach an equilibrium state and the more cooling capacity and speed the system can achieve.

This possess a technical challenge since in usual vacuum cooling systems, water is used as a refrigerant and to boil water in a vacuum system to cool it down to say 0° C. the vacuum level should be ~20.37 Torr (approx. 2716 Pa). Mostly oil-sealed vacuum pumps can maintain that level of vacuum, yet at that level of deep vacuum the amount of gas flow the pump is pulling is very low, meaning the boiling rate will be very low as well since the vacuum pump flow rate is inversely proportional to the vacuum level in the low-pressure region as shown in FIG. 2 with an example of a vacuum pump performance curve.

Water is the main refrigerant used in current vacuum cooling systems due to the fact that usually this method of cooling is used to rapidly cool food products by vaporizing the water content out of the body of the product you need to cool you get the cooling effect, so the liquid have to be non-toxic and safe for human consumption.

With using water as a refrigerant, a high capacity high energy consuming vacuum pump is needed to reach high level of vacuum along with high flow rate. That is achievable with oil sealed vacuum pumps, however since water evaporates, water vapour mixing with the pump oil will break the pump and every vacuum pump have a maximum water vapour capacity per minute that it could handle that's why a "Vapour Trap" or cold trap is required to condense the water vapour and maintain the condensed reservoir at lower temperature than the product to be cooled. Since both, the body of water to be cooled and the condenser reservoir are behind the vacuum line and both are depressurized, the liquid reservoir with the higher temperature has higher boiling point (regarding pressure, i.e. it boils at higher pressure) and will evaporate first. Since we always want to evaporate the liquid that we want to cool and not the freshly condensed vapour reservoir, we need to always keep the condensed reservoir at lower temperature all the time so that the liquid we want to cool will always have a higher boiling point and will always boil off first also in order to prevent the condensed reservoir to boil off and vapour entering from there into the pump. This cold trap requires another refrigeration cycle, typically a VCRS cycle as shown in WO 2015/116903 A1.

Also, with the current vacuum cooling systems, the item to be cooled has to be physically inside the depressurized chamber (Vacuum Chamber) as shown in WO 2015/116903 A1 in which not all items can be compatible to withstand the vacuum environment. The present disclosure concerns a vacuum cooling system that provides rapid cooling yet the item to be cooled can be outside the vacuum chamber in room pressure. This allows not only solid or liquid products to be cooled but also a gas can be cooled as well. A second benefit is that it eliminates the need to use vapour trap, which means that the system doesn't need another cooling cycle, thereby minimizing the overall size and cost of the system; third it requires less deep a vacuum to reach the boiling state, hence minimizing energy use, in which the shortcomings of the above mentioned vacuum cooling system is overcome, the system provides rapid cooling in an efficient, regenerative and less complicated system The system depends on a cycle in which a volatile low boiling point liquid with a boiling point above that of the room temperature (~20° C.) is used as a refrigerant, for example Acetone with a boiling point of 56° C., when the liquid is put in a vacuum chamber connected to a vacuum pump in which by lowering the pressure the liquid starts to boil, the vapour then pass through a heat exchanger, since its boiling point at 1 atmospheric pressure is higher than room temperature it will be condensed almost all of the vapour back to liquid state to be reused. The problem with replacing water as a refrigerant with any other material is that when using water, part of the water is vented out to the environment during cooling, that is because in any vacuum system the vacuum pump is pulling vacuum on one side and venting to the atmosphere on the other side, you cannot make a closed cycle as VCRS where the refrigerant is in a closed loop indefinitely. This is due to leaks in any vacuum system; pressure will build up and eventually you will need to vent out some gas to reduce the pressure.

In a water vacuum cooling system, the product gets in the chamber with high water content and leaves with less water after the cooling cycle, the loss of water is not a problem in this case, while when using a different refrigerant with lower boiling point the refrigerant has to stay in a closed loop since you cannot vent the vapour to the environment due to the potentially hazardous nature of the material and due to the system needing to run continuously without the need to keep adding more refrigerant. The other reason is in any vacuum system air from the surroundings leaks in and leakage air dissolve some of the vapour refrigerant that is evaporated during the cooling phase and carries it away and vents out of the system, wasting refrigerant and polluting the environment. To reduce these effects, the vapour exiting the vacuum pump enters a heat exchanger, in which reducing the vapour temperature to lower than its boiling point at given pressure, the vapour changes phase to a liquid form that enters back to the vacuum chamber for reuse. However, leakage air saturated with some of the vapour leads to a small amount of the refrigerant being vented out with the leakage air. To prevent such leakage, a filtration system may be designed specifically to separate air from the volatile liquid. Passing the mix through an absorbent material as shown in JP H06 129736 A will, however, not guarantee a high level of extraction since pushing air mixed with the vapour directly in a body of liquid results in the air forming bubbles carrying an amount of refrigerant at the core of the bubble and only the outer surface of that bubble is in contact with the absorbent material, resulting in a loss of most of the refrigerant over time. Besides, the system shown in JP H06 129736 A uses a refrigerant gas and a compressor and therefore is essentially a vapour-compression refrigeration system and not a vacuum cooling system.

With our system we choose a refrigerant that is compatible with the absorbent liquid so that it dissolves readily upon contact. Instead of directly pushing the leakage air with vapour mix into the absorbent liquid and creating bubbles, we first create a fine mist from the absorbent liquid, introduce the mixture to the mist and give enough space to mix together, the leakage air enters the chamber filled with fine mist, the surface area of the liquid mist that is exposed to the mixture is increased exponentially giving a lot of surface area for the leakage air refrigerant mixture to be exposed to the absorbent in this form extracting almost all of the refrigerant from the leakage air, then for the leakage air to exit the system it has to pass through the absorbent liquid reservoir offering a second filtration step. Over time the level of the refrigerant in the main water tank will drop and more of the refrigerant will be dissolved in the absorbent material. To recover and re-use the refrigerant that is dissolved in the absorbent material, we switch the vacuum pump line from the main vacuum chamber to a secondary vacuum chamber, which is connected to the recovery tank, once vacuum pump starts lowering the pressure in the secondary vacuum chamber it will pull much of the absorbent material up to the secondary vacuum chamber until it reach a certain limit when level sensor closes the flow and seal the tank, since vacuum pump is reducing the pressure and since the refrigerant has a lower boiling point than the absorbent material, the refrigerant will start boil off the absorbent material to be extracted and reused, the extraction cycle will go until the vacuum reach a certain level which is −29 INHG (~3110 Pa) absolute so at this point theoretically most of the refrigerant will be evaporated yet not enough to evaporate the absorbent material.

The vapour extracted follows the path of first flow of heat exchange and the vapour condenses to liquid for re-use.

The present disclosure concerns a cooling system using vacuum cooling (or "vacuum evaporation", i.e. evaporation happening under vacuum conditions) having a refrigerant circulation, the refrigerant circulation comprising: a vacuum chamber, a vacuum pump, a first flow of a heat exchanger of the cooling system having at least two flows, and a condensate reservoir, wherein the vacuum chamber, the vacuum pump, the first flow and the condensate reservoir are connected (to provide the refrigerant circulation), wherein a refrigerant contained within the refrigerant circulation is liquid at 20° C. and 101325 Pa (i.e. normal temperature and pressure), and a method to operate such a system. In this context, normal temperature and pressure is defined as 20° C. at 1 atm (according to the NIST definition); optionally, the boiling point of the refrigerant is above 22° C. at 1 atm. The heat exchanger of the cooling system may have a first flow and a second flow. The refrigerant circulation uses the first flow of the heat exchanger.

Such vacuum-evaporation cooling systems have been previously presented. EP 0 577 869 B1 discloses a water-based cooling system. Vacuum pumps compress water vapour that condenses on cold condensation surfaces and may be withdrawn and recycled to a storage vessel connected to an evaporator.

U.S. Pat. No. 9,897,364 B2 discloses another cooling system that uses a water/alcohol solution as a coolant. A primary refrigerant circulation is completely closed and comprises two branches for cooling different components of a refrigerator.

WO 2015/116903 A1 shows a vacuum cooling system, although without a circulation of the refrigerant. Instead, the refrigerant is evaporated from a wetted material contained in a container compartment and in contact with bottles to be cooled. The water evaporates from the rattled material due to vacuum in the container compartment, travels to a vapour trap, condenses and is discharged.

It is an object of the present invention, to provide a way of rapid cooling that is regenerative, small in size can cool items outside of the vacuum chamber at room pressure, can chill any material solid, liquid or gas and energy efficient using vacuum cooling.

The invention proposes a cooling system of the kind stated in the outset (i.e. a vacuum cooling system), comprising a separator having an inlet connected to the condensate reservoir for receiving a gaseous phase from the condensate reservoir, an outlet connected to an inlet of the vacuum pump and an exhaust for leakage air. Analogously, the invention proposes a method of the kind stated in the outset, comprising the following steps: withdrawing a gaseous phase from the refrigerant circulation at the condensate reservoir, separating refrigerant from the gaseous phase, exhausting the remaining gaseous phase (i.e. leakage air), and returning the separated refrigerant to the refrigerant circulation. The separator as defined above generally refers to a subsystem configured to perform the step of separating refrigerant from a gaseous phase withdrawn from the refrigerant circulation via the inlet. Since the refrigerant is liquid at 20° C. and 101325 Pa (normal temperature and pressure), it can be condensed at room conditions. This saves energy otherwise necessary for cooling and/or de-compressing the refrigerant beyond normal temperature and pressure.

The present disclosure is based on the realisation that present vacuum cooling systems having a refrigerant circulation (i.e. a closed loop of refrigerant) are limited in their operation by the problem of air leaks. Generally, the removal of leakage air saturated with the refrigerant leads to a loss of vacuum and consequently increasing energy consumption.

The present disclosure proposes a way to remove leakage air from the refrigerant circulation without any significant loss of refrigerant. By reducing the problem of leakage air, the present disclosure alleviates the downsides of the use of oil-free vacuum pumps in vacuum cooling systems. As further consequence, it enables the use of refrigerants that are incompatible with oil-sealed vacuum pumps, because they dissolve in the sealing oil, while at the same time no cold traps are necessary to avoid an oil mixture or oil solution. Therefore, the present system can provide rapid cooling in a simpler and more cost-effective in production and maintenance.

Optionally, the separator comprises a capturing means for capturing refrigerant vapour from the gaseous phase received via the inlet. Capturing may be performed by modifying the gaseous phase, e.g. by changing the mixture the gaseous phase by adding further components. The purpose of capturing is to transfer the refrigerant from a mixture of leakage air to a mixture or solution with a different substance, which can be separated more easily from leakage air.

The capturing means may comprise a spray chamber for producing a mist of a capturing solvent. The capturing solvent is chosen such that it dissolves the refrigerant, thereby changing the mixture of leakage air and the refrigerant to a mixture of leakage air and capturing solvent with refrigerant dissolved therein. For example, the capturing solvent may be chosen such that the refrigerant dissolves eagerly therein. Correspondingly and to similar advantages, the separating of the present method may comprise capturing refrigerant vapour in the gaseous phase with a mist of a capturing solvent, in which the refrigerant dissolves eagerly. Alternatively, the capturing solvent may be chosen such that it is highly miscible with the liquid refrigerant, in which case. The capturing solvent may be liquid at normal temperature and pressure. In this instance, the capturing means may be operated at normal temperature and pressure, thereby saving energy.

In one embodiment, the separator comprises a first phase separator for separating leakage air in a gaseous phase from a solution of refrigerant in a capturing solvent. The capturing solvent may be the same capturing solvent as described above, however, the first phase separator may be used irrespective of how the solution of refrigerant in the capturing solvent has been obtained, i.e. not necessarily with a capturing means having a spray chamber. Correspondingly, the separating of the present method may comprise phase separating the remaining gaseous phase (e.g. after the capturing step mentioned above) from a solution of refrigerant in the capturing solvent. Analogously, the first phase separator is configured to separate a liquid phase from a gaseous phase. For example, phase separation may be performed by storing the phase mixture in a container or tank, wherein the gaseous phase will rise in the liquid phase due to the different density, accumulates in an upper part of the container or tank and can be removed via an exhaust from said upper part. Optionally, the first phase separator is configured to operate at about normal temperature and pressure or slightly above, thereby avoiding the need of heating and thus saving energy that may otherwise be required for phase separation.

The separator may comprise a solvent circulation for a capturing solvent, wherein said solvent circulation comprises a circulation pump. A solvent circulation allows for reuse of the capturing solvent for different process steps carried out by the separator, such as for example capturing and phase separation. Alternatively, the capturing solvent may be discarded once the refrigerant is separated from the leakage air and from the capturing solvent, and fresh capturing solvent may continuously be fed into the separator.

The solvent circulation optionally comprises a second flow of the heat exchanger and a radiator for dissipating heat from the capturing solvent to the surrounding atmosphere. In this case, the solvent circulation can serve a double purpose: on the one hand, as a component of the separator to support the removal of leakage air from the refrigerant circulation; on the other hand, as an intermediate heat transfer medium or heat convection medium for absorbing heat from the refrigerant via the heat exchanger and downstream the heat exchanger dissipating the absorbed heat to the surroundings via a radiator. This helps to reduce the amount of refrigerant in the system, because the heat exchanger can be dimensioned smaller than the radiator, and the refrigerator can be better and more safely contained, because it does not need to enter the radiator itself, which radiator naturally being exposed surroundings is more prone to mechanical damage and leakage. By using solvent circulation for both purposes, a single pump is sufficient, wherein separate circulations for the capturing solvent and an additional heat convection medium would require two pumps and therefore have a higher energy consumption in operation.

In a further embodiment, the separator comprises a second phase separator for separating refrigerant in a gaseous phase from a solution of refrigerant in a capturing solvent, wherein the second phase separator is connected to the vacuum pump. Correspondingly, the separating of the present method may comprise phase separating the refrigerant from a solution of refrigerant in the capturing solvent. The second phase separator may be configured to receive a solution of refrigerant in the capturing solvent in a liquid state of aggregation via an inlet during a loading step. Then, an inlet of the second phase separator may be tightly closed, and a connection to the vacuum pump opened. During the subsequent separation step the pressure inside the second phase separator is decreased due to the action of the vacuum pump. When the pressure drops below the vapour pressure of the refrigerant, the refrigerant moves to a gaseous state of aggregation with a significantly lower density than the still liquid capturing solvent. Thereafter, as described above for the first phase separator, phase separation in the second phase separator may be performed by storing the phase mixture in a container or tank, wherein the gaseous phase of refrigerant will rise in the liquid phase of the capturing solvent due to the different density, the gaseous phase accumulates in an upper part of the container or tank and can be returned from said upper part to the refrigerant circulation. For example, the connection to the vacuum pump may also be used for returning the gaseous refrigerant to the refrigerant circulation. In this example, the vapour pressure of the refrigerant is lower than that of the capturing solvent. More generally, the capturing solvent used in the present disclosure may have a higher boiling point than the refrigerant. However, the present disclosure is not limited to this situation. For example, the phase separation may also be performed by withdrawing and returning liquid refrigerant which is separated from a gaseous phase of the capturing solvent. The second phase separator may be configured to operate at normal temperature (i.e. about 20° C.) between normal pressure and the boiling pressure of the refrigerant.

Correspondingly, regarding the present method, all separating steps may be performed at approximately room temperature. In this case, any additional heating can be avoided and the only work directly contributing to the cooling is that of the vacuum pump, which—in some instances described above—can be less than for comparable cooling systems.

The refrigerant may have a lower boiling point than water at 1 atm. In consequence, the vapour pressure of the refrigerant will be higher than that of water. Overall, the boiling point of the refrigerant at 1 atm can be between 20° C. and 100° C. This allows for energy savings regarding the necessary work performed by the vacuum pump in order to achieve evaporation of the refrigerant in the vacuum chamber and thereby cooling, because only a lower-quality vacuum is necessary in the vacuum chamber as compared to a vacuum-evaporation cooling system using water as the refrigerant.

As a further possible advantage of the present disclosure, it achieves a rapid cooling and a unique way to rapidly and efficiently cool a medium in a regenerative way. Specifically, the faster cooling effect can be achieved by the use of a volatile liquid (e.g. acetone) having a lower boiling point than water at 1 atm. The volatility of the liquid means that it needs significantly less energy than water to make it boil at a certain temperature. As a result, lower vacuum levels (i.e. higher absolute pressure) are needed to achieve boiling. As a further consequence, a higher flow rate of the vacuum pump is achieved and the liquid can be evaporated at higher rates, thus withdrawing relatively more heat energy from the vacuum chamber.

In one embodiment of the present disclosure, the refrigerant preferably is an acetone-based refrigerant. For example, the refrigerant may comprise at least 80 vol % acetone, preferably at least 90 vol %, in particular at least 95 vol %, in the liquid phase inside the condensate reservoir.

BRIEF DESCRIPTION OF THE FIGURES

Referring now to the drawing, wherein the figure is for purposes of illustrating the present disclosure and not for purposes of limiting the same, FIG. 1 schematically shows a cooling system based on vacuum cooling according to the present disclosure.

DETAILED DESCRIPTION

Figure 1:
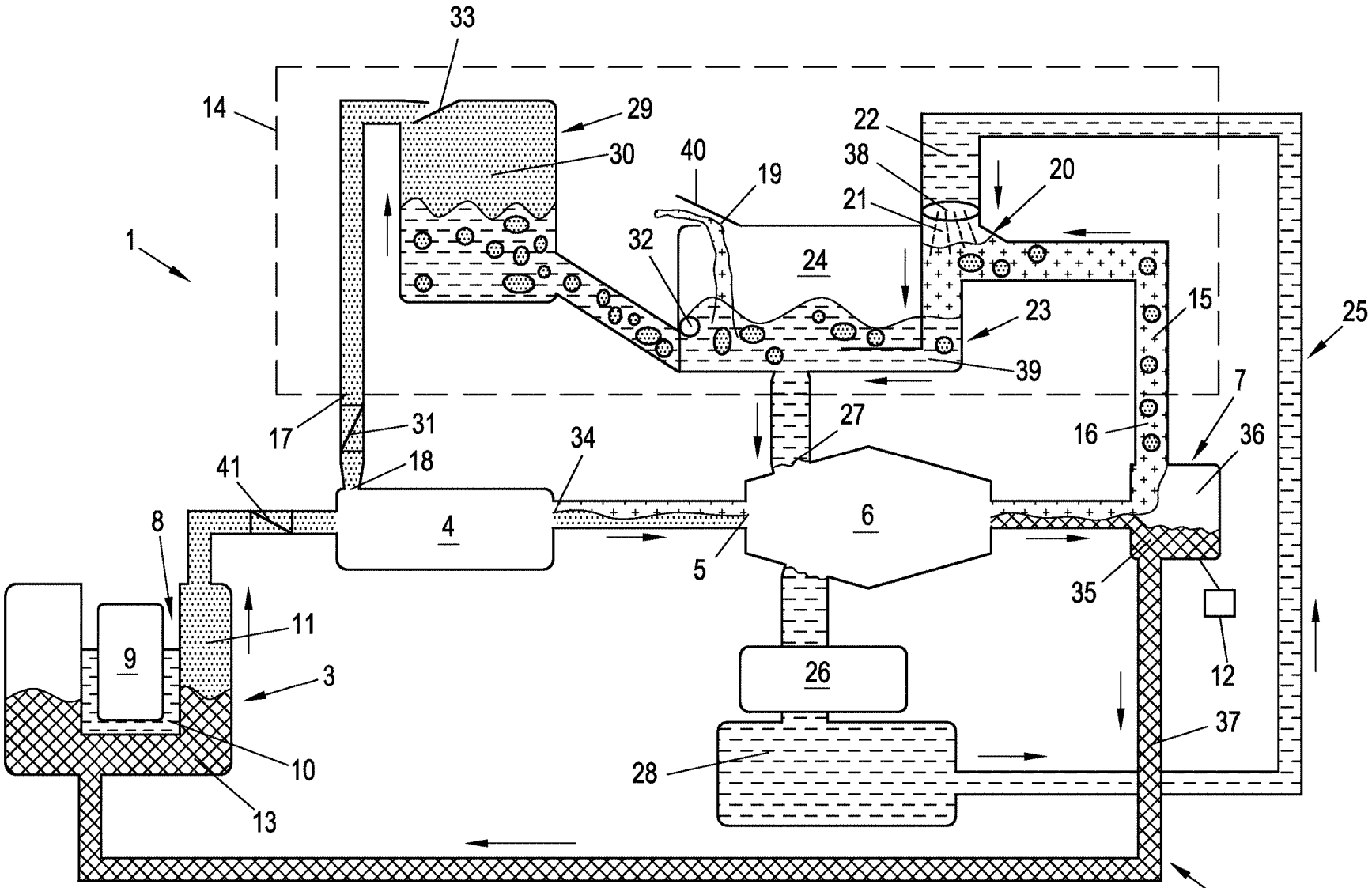
Figure 2:
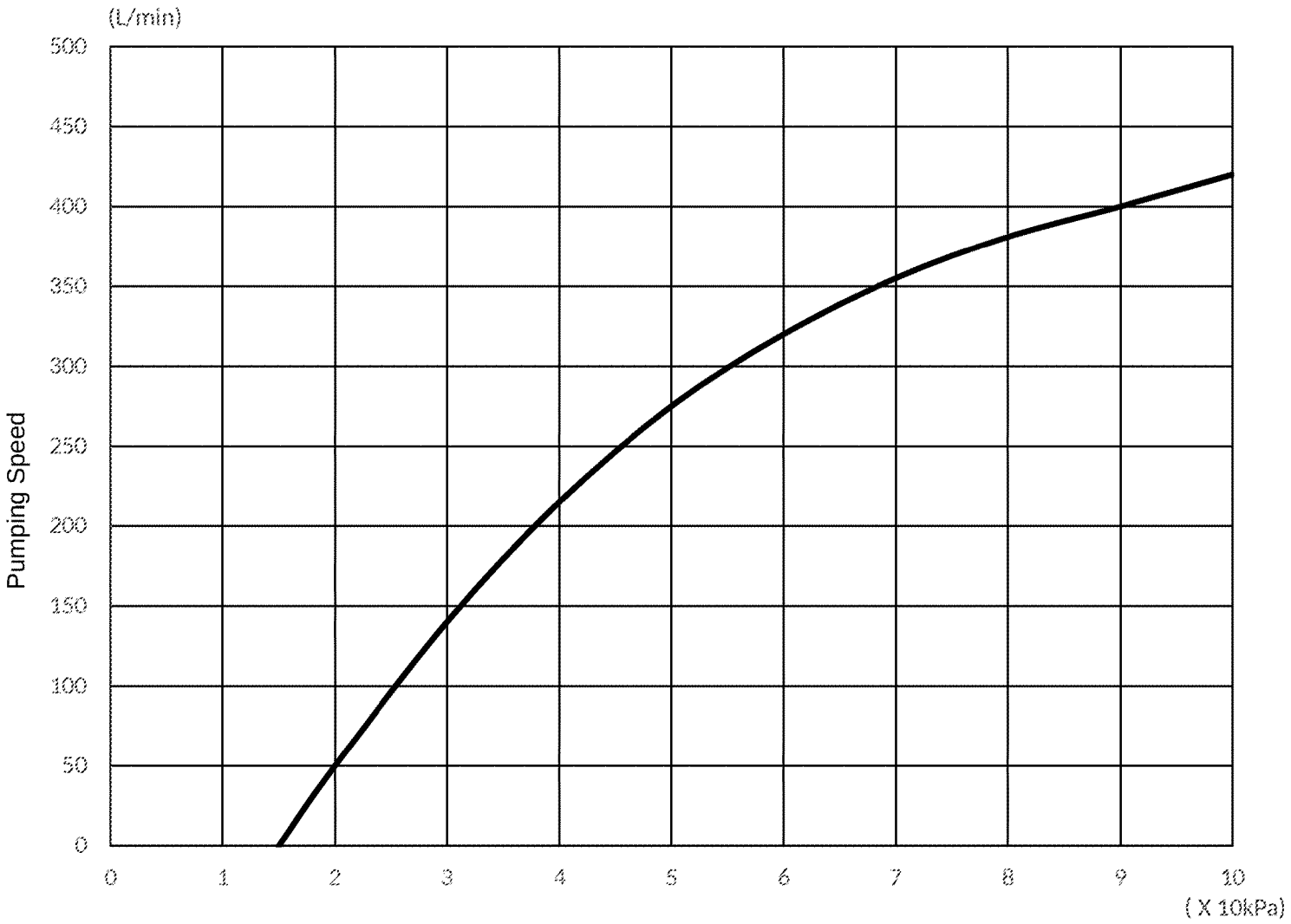
FIG. 2 shows an example of a vacuum pump performance curve.

FIG. 1 shows a cooling system 1 using vacuum cooling and having a refrigerant circulation 2. The refrigerant circulation 2 comprises a vacuum chamber 3, a vacuum pump 4, a first flow 5 of a heat exchanger 6 and a condensate reservoir 7. The vacuum chamber 3 may be arranged around a receptacle 8, e.g. for a beverage container 9 (usually a can or bottle). Heat exchange between the vacuum chamber 3 and that the beverage container 9 can be facilitated by a small amount of water 10 surrounding the beverage container 9. The beverage container 9 may be connected to a motor (not shown) to spin it to help dispense the heat inside the container 9 faster. The vacuum pump 4 is an oil-free pump, e.g. a piston pump or a diaphragm pump. It is directly connected to the vacuum chamber 3, more specifically an upper part 11 of the vacuum chamber 3, in order to be able to evacuate the vacuum chamber 3. The heat exchanger 6 can be a plate heat exchanger. The condensate reservoir 7 is connected to an electrostatic discharge 12 to avoid any static charges building up in the presence of a flammable refrigerant and leakage air.

The refrigerant 13 contained within the refrigerant circulation 2 is 99 vol % pure acetone. This refrigerant 13 has a boiling point of 56° C. at 1 atm and is therefore liquid at normal temperature and pressure. In warmer locations, i.e. at relatively higher expected surrounding temperature, a refrigerant having a slightly higher boiling point may be used; for example, ethanol with a boiling point of 78° C. at 1 atm. In the vacuum chamber 3, the liquid refrigerant 13 surrounds the receptacle 8 in order to facilitate direct heat transfer from an object or substance contained in the receptacle 8 into the liquid refrigerant 13 contained in the vacuum chamber 3.

The system 1 comprises a separator 14. The separator 14 has an inlet 15 connected to the condensate reservoir 7 for receiving a gaseous phase 16 from the condensate reservoir 7, an outlet 17 connected to an inlet 18 of the vacuum pump 4 and an exhaust 19 for leakage air. Moreover, the separator 14 comprises a capturing means 20 for capturing refrigerant vapour from the gaseous phase 16 received via the inlet 15. The capturing means 20 comprises a spray chamber 21 for producing a mist of water, which is used as a capturing solvent 22 for the refrigerant 13.

Downstream of the spray chamber 21, the separator 14 comprises a first phase separator 23 for separating leakage air in a gaseous phase from a solution of refrigerant in a capturing solvent. The first phase separator 23 is formed by a main water tank 24.

The spray chamber 21 and the main water tank 24 are parts of a solvent circulation 25 of the separator 14 for a capturing solvent (for simplicity, but without limitation, the dashed border indicating the separator 14 does not enclose the complete solvent circulation 25). The solvent circulation 25 comprises a circulation pump 26. Moreover, the solvent circulation 25 comprises a second flow 27 of the heat exchanger 6 and a radiator 28 for dissipating heat from the capturing solvent 22 (water) to the surrounding atmosphere. The circulation pump 26 is used to convey water from the main water tank 24 through the heat exchanger 6, the radiator 28 and the spray chamber 21 back to the main water tank 24. In the present example, the circulation pump 26 is arranged downstream of the heat exchanger 6 (its second flow 27) and upstream of the radiator 28.

The separator 14 comprises a second phase separator 29 for separating refrigerant in a gaseous phase from a solution of refrigerant in a capturing solvent. The phase separation is performed inside a recovery tank 30 of the second phase separator 29. The recovery tank 30 is connected to the vacuum pump 4 for controlling the pressure inside the recovery tank 30. The connection between the recovery tank 30 and the vacuum pump 4 comprises a recovery outlet valve 31. The recovery tank 30 is also connected to the main water tank 24 via a recovery inlet valve 32. Finally, the recovery tank 30 comprises a ventilation valve 33.

In operation, the example shown in FIG. 1 comprises multiple circulations or cycles: first, the primary cooling cycle formed by the refrigerant circulation 2; second, a secondary cooling cycle formed by the solvent circulation 25; and third, a regenerative cycle for recovering refrigerant from a gaseous phase. The regenerative cycle overlaps with the primary cooling cycle in a first section between the vacuum pump 4 and the condensate reservoir 7 and overlaps with the secondary cooling cycle in a second section between the capturing means 20 and the second phase separator 30. In the following, the different cycles will be explained in more detail.

When first starting operation of the system, the cooling and regenerative cycle starts at room temperature and pressure inside the vacuum chamber 3. The acetone refrigerant 13 is mainly in a liquid state of aggregation within the vacuum chamber 3. Once the vacuum pump 4 started, it lowers the pressure inside the vacuum chamber 3 down to approximately 9870 Pa (−27 inHg) or below. While the pressure continues to be lowered, acetone refrigerant 13 inside the vacuum chamber 3 will start to boil off and evaporate at lower and lower temperatures absorbing heat from within the body of liquid acetone refrigerant 13 itself and from the beverage container 9. At approximately 9870 Pa (−27 inHg) pressure, acetone can still boil down to zero degree Celsius.

On the outlet 34 of the vacuum pump 4 the pressure will be close to 1 atm and temperature of the vapor will stay at about 56° C. Since Acetone boils at 56° C., the vapour will be at this exact temperature at the moment of evaporation and it will go through the vacuum pump piston all the way across the vacuum pump outlet almost at the same temperature. Since leaks are inevitable in any vacuum system, the vacuum pump 4 will probably suck in air from the surrounding environment, which will be transported as leakage air from the vacuum pump outlet 34. Therefore, the pressure at the outlet is equalized with the surroundings, which is around 1 atm; better vacuum pumps might guarantee less leaks, hence lower outlet pressure. The mixture of acetone refrigerant vapour and leakage air enters the heat exchanger 6, where it exchanges heat with water coming from the main water tank 24. Since the water is staying at room temperature (approximately 22° C.), the acetone refrigerant will instantly condense back to liquid state and lose all its heat to the water. Once the acetone refrigerant is condensed, it enters the condensate reservoir 7. The condensate reservoir 7 acts as a phase separator between condensed and liquid refrigerant in a lower part 35 and the remaining refrigerant vapour mixed with leakage air in an upper part 36.

From the condensate reservoir 7, the liquid refrigerant is sucked through a narrow tubing 37 into the vacuum chamber 3 due to the negative pressure. The diameter of the tubing may be between 0.1 and 0.5 mm. The choice of diameter depends on the rate of condensation of the refrigerant and the volume of the reservoir at the condensate reservoir 7. Thus, it can be configured to conduct at the foreseen pressure difference at maximum the same amount of refrigerant that can be condensed in the heat exchanger 6 and the condensate reservoir 7 at the foreseen temperature difference. The tube diameter is small enough to maintain a target maximum pressure difference when the vacuum pump 4 is operating at its maximum capacity or below. In other words, the diameter should be small enough to essentially avoid a pressure drop in the condensate reservoir 7 and a significant pressure increase and the vacuum chamber 3. When the operation of the vacuum pump 4 is suspended, the vacuum chamber 3 will slowly equalise pressure with the condensate reservoir 7 and the rest of the system. However, after activation of the vacuum pump 4, the pressure gradient between condensate reservoir 7 and vacuum chamber 3 can be built up within a few seconds due to the limited flow rate through the narrow tubing 37. The choice of using a narrow tubing 37 to establish a foreseen pressure gradient helps to minimise the number of moving parts in the system and consequently to minimise the probability of system faults.

During condensation of the vapour acetone refrigerant, the heat will be transferred in the heat exchanger 6 from the first flow 5 containing the refrigerant at a temperature of about 56° C. to the second flow 27 containing water at about room temperature. The circulation pump 26 circulates the water from the main water tank 24 down to the heat exchanger 6 and further down to the radiator 28, where its extra heat (i.e. for a temperature above room temperature) is dissipated to the surrounding atmosphere and get back to the main water tank 24 at room temperature of approximately 22° C.

Although the condensation of the vapour acetone refrigerant could reach high levels and most of it will be recovered in the heat exchanger 6 to be reused, it may not be 100% recovery since there can always be acetone vapour saturated in the leakage air leaked into the system. Since any loss of refrigerant should be avoided, the refrigerant in the system should be recovered for re-use as completely as possible. According to the present example, this recovery is achieved by withdrawing a gaseous phase from the refrigerant circulation 2 at the condensate reservoir 7, separating refrigerant from the gaseous phase, exhausting the remaining gaseous phase, and returning the separated refrigerant to the refrigerant circulation 2.

More in detail, the step of separating refrigerant from the gaseous phase comprises three stages: the first stage for capturing refrigerant vapour in the gaseous phase with a mist of a capturing solvent, the second stage for separating the remaining gaseous phase from a solution of refrigerant in the capturing solvent, and the third stage for separating the refrigerant from the solution of refrigerant in the capturing solvent. As mentioned above, the capturing solvent for the acetone refrigerant can be water. Generally, it will be a solvent, in which the refrigerant dissolves eagerly.

For the first stage, the water pumped by the circulation pump 26 through the radiator 28 will arrive at a water spray nozzle 38 of the spray chamber 21. This nozzle 38 will turn the arriving water to a mist that can mix with the gaseous phase received from the condensate reservoir 7 (i.e. essentially a saturated mixture of leakage air and vapour acetone refrigerant). Since acetone is highly miscible and easily dissolves in water due to its dipole moment of 2.91D, and water is a very polar substance, the water mist will attract and absorb any remaining acetone vapour that is still mixed and carried in the leakage air. The mist (now a water/acetone solution mixed in air) is guided to the main water tank 24.

In the main water tank 24, acting as the first phase separator 23, the leakage air that is still in the system will vent out down through a submerged inlet 39 into the water tank 24. This requires a pressure slightly elevated over the surroundings (e.g. above 1 atm) in the spray chamber and back through the recovery tank and the heat exchanger, in order for the leakage air to be pushed below the underwater barrier. Although after the acetone vapour condenses after the heat exchanger, there will be slight pressure drop due to a lot of gaseous mass condensed to liquid, though the continuity of pumping there will eventually build-up pressure upstream of the water tank 24 high enough to push the leakage air through the water and out of the system. The vacuum pump acts as a vacuum generator on one side and as a compressor on the other, so it will eventually push the gases out.

The submerged inlet 39 will serve two purposes: first, if there is still any acetone vapour in the gaseous phase, mixing it with water will absorb any acetone left; second, the water can act as a fire extinguisher, since acetone is highly flammable, in case there is a fire outside the system the first line of contact with the outside environment is the water so it will inhibit any fire from the start. From the main water tank 24, the leakage air raising from the liquid solution at room temperature will be vented out through the exhaust outlet 19 comprising a one-way valve 40.

Since there will be a small amount of acetone dissolved in the main water tank 24, it needs to be recovered. For this purpose, the recovery tank 30 will trap some of the water from the main water tank 24 and will act as a temporary vacuum chamber. By closing certain valves, the vacuum pump 4 is used to evacuate the temporary vacuum chamber, while the pressure in the main vacuum chamber 3 is not affected. As a consequence, the pressure in the temporary working chamber decreases until the acetone refrigerant acetone dissolved in the water starts to boil off and can be phase separated and extracted.

The regenerative cycle follows an intermittent operation, alternating between a regeneration phase where the temporary vacuum chamber is evacuated and refrigerant returned to the refrigerant circulation 2, and a reloading phase where the pressure in the temporary vacuum chamber is equalized with the main water tank 24 and the water contained in the temporary vacuum chamber is replaced. To start the regenerative cycle with a regeneration phase, the vacuum chamber outlet valve 41 and the ventilation valve 33 are closed and the recovery outlet valve 31 is opened. Once the vacuum pump 4 starts during the regeneration phase, the pressure inside the temporary vacuum chamber will be lowered. Since the pressure in the main water tank 24 is the atmospheric pressure and the temporary vacuum chamber is at a lower pressure now, water will flow to the lower pressure, from the main water tank 24 into the temporary vacuum chamber (i.e. the recovery tank 30). The connection between the two comprises a recovery inlet valve 32 formed by a floating device. Once the water level in the main water tank 24 reaches a certain minimum level, the floating device will close the outlet of the main water tank 24 to the recovery tank 30, hence isolating the temporary vacuum chamber into an airtight chamber that can be evacuated.

Once the pressure starts to decrease in the temporary vacuum chamber, the acetone refrigerant will begin to boil off out of the capturing solvent (here: water) at room temperature and evaporate, turning to a vapour, because the capturing solvent has a higher boiling point than the refrigerant. The acetone refrigerant vapour will be withdrawn from the temporary vacuum chamber and returned to the refrigerant circulation 2 at the vacuum pump 4, following the primary cooling cycle described above. Once a certain target vacuum (e.g. ~3110 Pa) is achieved in the temporary vacuum chamber, the regeneration phase ends and the recovery tank 30 moves to the reloading phase. At this level of vacuum at room temperature (or a bit less than room temperature since boiling off acetone will cool the water) means there isn't much acetone left in the system to boil. The recovery outlet valve 31 is closed and the vacuum chamber outlet valve 41 is opened. At the same time, the ventilation valve 33 is opened to depressurize the recovery tank 30. Once the recovery tank 30 equalises the pressure difference to the main water tank 24, the floating device 32 opens and the water contained in the recovery tank 30 flows down to the main water tank 24 under the influence of gravity due to the recovery tank 30 being at a higher level than the main water tank 24.

The invention claimed is:

1. A cooling system using vacuum cooling and having a refrigerant circulation, the refrigerant circulation comprising:

a vacuum chamber, a vacuum pump, a first flow of a heat exchanger of the cooling system, a condensate reservoir, and a separator, wherein the heat exchanger has at least two flows, wherein the vacuum chamber, the vacuum pump, the first flow and the condensate reservoir are connected, wherein a refrigerant contained within the refrigerant circulation is liquid at 20° C. and 101325 Pa, wherein the separator has an inlet connected to the condensate reservoir for receiving a gaseous phase from the condensate reservoir, an outlet connected to an inlet of the vacuum pump and an exhaust for leakage air, and wherein the separator comprises a capturing means for capturing refrigerant vapour from the gaseous phase received via the inlet.

2. The system according to claim 1, wherein the refrigerant has a lower boiling point than water at 1 atm.

3. The system according to claim 2, wherein the refrigerant is an acetone-based refrigerant.

4. The system according to claim 1, wherein the capturing means comprises a spray chamber for producing a mist of a capturing solvent.

5. The system according to claim 4, wherein the separator comprises a first phase separator for separating leakage air in the gaseous phase from a solution of refrigerant in the capturing solvent.

6. The system according to claim 5, wherein the separator comprises a second phase separator for separating refrigerant in the gaseous phase from the solution of refrigerant in the capturing solvent, wherein the second phase separator is connected to the vacuum pump.

7. The system according to claim 4, wherein the separator comprises a solvent circulation for the capturing solvent, wherein said solvent circulation comprises a circulation pump.

8. The system according to claim 7, wherein said solvent circulation comprises a second flow of the heat exchanger and a radiator for dissipating heat from the capturing solvent to the surrounding atmosphere.

9. A method to operate a cooling system using vacuum cooling and having a refrigerant circulation, the refrigerant circulation comprising:

a vacuum chamber, a vacuum pump, a first flow of a heat exchanger of the cooling system, and a condensate reservoir, wherein the heat exchanger has at least two flows, wherein the vacuum chamber, the vacuum pump, the first flow and the condensate reservoir are connected, wherein a refrigerant contained within the refrigerant circulation is liquid at 20 C and 101325 Pa, wherein the method comprises the following steps:

withdrawing a gaseous phase from the refrigerant circulation at the condensate reservoir, separating refrigerant from the gaseous phase, exhausting the remaining gaseous phase, and returning the separated refrigerant to the refrigerant circulation, and wherein the separating step comprises capturing refrigerant vapour in the gaseous phase with a mist of a capturing solvent, in which the refrigerant dissolves eagerly.

10. The method according to claim 9, wherein the capturing solvent has a higher boiling point than the refrigerant.

11. The method according to claim 9, wherein all separating steps are performed at approximately room temperature.

12. The method according to claim 9, wherein the separating step further comprises phase separating the remaining gaseous phase from a solution of refrigerant in the capturing solvent.

13. The method according to claim 12, wherein the separating step further comprises phase separating the refrigerant from a solution of refrigerant in the capturing solvent.

* * * * *